US009202364B2

(12) United States Patent
Siber et al.

(10) Patent No.: US 9,202,364 B2
(45) Date of Patent: Dec. 1, 2015

(54) WIRELESS ALARM DEVICE FOR DETECTING AND COMMUNICATING ENVIRONMENT AND SYSTEM SPECIFIC STATES USING THE INTERNET

(71) Applicant: Robert Bosch GmbH, Stuttgart (DE)

(72) Inventors: Bernd Siber, Baiern-Antholing (DE); Ulrich Oppelt, Zorneding (DE)

(73) Assignee: Robert Bosch GmbH, Stuttgart (DE)

( * ) Notice: Subject to any disclaimer, the term of this patent is extended or adjusted under 35 U.S.C. 154(b) by 0 days.

(21) Appl. No.: 14/450,659

(22) Filed: Aug. 4, 2014

(65) Prior Publication Data

US 2014/0354425 A1 Dec. 4, 2014

Related U.S. Application Data

(62) Division of application No. 13/504,582, filed as application No. PCT/EP2010/062722 on Aug. 31, 2010, now abandoned.

(30) Foreign Application Priority Data

Oct. 28, 2009 (DE) ..... 10 2009 046 096

(51) Int. Cl.
*G08B 21/00* (2006.01)
*G08B 27/00* (2006.01)
*G08B 25/10* (2006.01)

(52) U.S. Cl.
CPC ..... *G08B 27/005* (2013.01); *G08B 25/10* (2013.01)

(58) Field of Classification Search
CPC ..... G08B 25/10; G08B 17/00
USPC ..... 340/628–630, 539.1, 539.11–539.17, 340/539.22–539.24
See application file for complete search history.

(56) References Cited

U.S. PATENT DOCUMENTS 6,829,478 B1 12/2004 Layton et al.
6,940,900 B2 9/2005 Takamizawa (Continued)

FOREIGN PATENT DOCUMENTS

JP 2002190079 7/2002
JP 2003224674 8/2003

(Continued)

OTHER PUBLICATIONS

Nina et al., "Design and implementation of a distributed fire alarm monitoring system based on GPRS," Fire Science and Technology, Jul. 2007, vol. 26, No. 4, pp. 425-427.

(Continued)

*Primary Examiner* — Jeffrey Hofsass
(74) *Attorney, Agent, or Firm* — Michael Best & Friedrich LLP

(57) ABSTRACT

The invention relates to an alarm device for detecting and communicating environment and device-specific states, comprising a communication interface for the wireless transmission of information G to one or more destination addresses B, wherein the communication interface is designed in particular as a WLAN interface and/or as a mobile radio interface, wherein the communication interface is designed in terms of program and/or circuitry to establish and/or maintain access to the public Internet (A) in order to transmit the information (G) to one or more destination addresses (B).

14 Claims, 3 Drawing Sheets

(56) References Cited

U.S. PATENT DOCUMENTS

| | | | |
|---|---|---|---|
| 7,019,646 | B1 | 3/2006 | Woodard et al. |
| 2006/0125632 | A1 | 6/2006 | Luebke et al. |
| 2007/0063833 | A1 | 3/2007 | Kates |

FOREIGN PATENT DOCUMENTS

| | | |
|---|---|---|
| JP | 2004038881 | 2/2004 |
| JP | 2005215731 | 8/2005 |
| JP | 4153822 | 9/2008 |
| WO | 2009111996 | 9/2009 |

OTHER PUBLICATIONS

Liang et al., "Fire alarm system with remote monitor and control based on ARM and GPRS," Foreign Electronic Measurement Technology, Dec. 2006, pp. 20-22.

LSN RF Fire Detection System, Bosch Security, Retrieved from Internet Mar. 1, 2012 <URL: http://resource.boschsecurity.com/documents/Data_sheet_enUS_1264521099.pdf>.

PCT/EP2011/062722 International Search Report and Written Opinion dated Oct. 27, 2010, 4 pages.

WIRELESS ALARM DEVICE FOR DETECTING AND COMMUNICATING ENVIRONMENT AND SYSTEM SPECIFIC STATES USING THE INTERNET

This application is a divisional of U.S. application Ser. No. 13/504,582, the disclosure of which is hereby incorporated by reference, and which was the National Stage of International Application No. PCT/EP2010/062722, filed Aug. 31, 2010.

BACKGROUND

The invention relates to an alarm device for detecting and communicating environment- and system-specific states, having a communication interface for wirelessly transmitting information to one or more destination addresses. The communication interface may take the form of a WLAN interface and/or a mobile radio interface, for example.

The task of alarm devices is to alert persons in an area surrounding the alarm device to a hazardous situation and thus to ultimately also be able to save lives. A plurality of alarm devices are usually integrated in apartments, buildings or building complexes and are networked to one another via cable or radio in order to be able to inform of the hazardous situation at any location. It is known from many applications that alarm devices are able to transmit an emergency call to an external service provider, for example, a security service or an operations center, via wire, or radio in order to quickly and specifically request help.

The document U.S. Pat. No. 7,019,646 B1 which probably forms the closest prior art describes an apparatus and a method for locating a wireless smoke alarm in the event of a potential fire. The wireless smoke alarm has an interface, for example a WLAN interface, to a wireless transceiver (transmitting/receiving system) which operates via an existing wireless telecommunication network. The wireless transceiver may be in the form of a processor with an integrated memory for storing alarm data. It is suitable for automatically transmitting the alarm data to an operations center in the event of an alarm.

SUMMARY

The alarm device according to one embodiment of the invention is designed to record, for example monitor, at least one environmental parameter and to transmit this parameter or a parameter derived therefrom as an environment-specific state. The alarm device preferably comprises a fire alarm, a smoke alarm, a motion detector or an existence detector for detecting the environmental parameter. In particular, the alarm device has a sensor unit which is suitable and/or designed to record an environmental parameter, for example a temperature, a gas concentration and/or a particle concentration, an image of the environment etc.

Alternatively or additionally, the alarm device is suitable and/or designed to record, in particular monitor, at least one functional parameter of the alarm device and to transmit this parameter as the device-specific state of the alarm device. The functional parameters may be, for example, characteristic variables of self-diagnosis or operating parameters of the alarm device.

The alarm device preferably has an evaluation unit which is suitable and/or designed to evaluate the parameters, for example the environmental parameters and/or the functional parameters, and to detect the environment- and/or device-specific state.

In the context of the invention, the environment-specific state should be understood as meaning, for example, an event which comprises, for example, a hazardous situation, for example a fire, an excessive smoke concentration, the movement of an object and/or the existence of an object. However, the environment-specific state can also comprise a normal situation, in particular a non-hazardous situation and/or an all-clear situation.

The device-specific state usually comprises a functionality and/or operating state status of the alarm device. If the operation and/or the function of the alarm device is/are available only to a restricted extent or is/are not available or if the alarm device is thus completely or partially defective, the device-specific state should likewise be understood as meaning an event.

The alarm device has a communication interface which is preferably in the form of a WLAN interface. The WLAN interface is preferably an interface to a wireless local area network, a local radio network based on the IEEE 802.11 standard, which usually uses OFDM (Orthogonal Frequency Division Multiplex) as the modulation method. In particular, the alarm device has a WLAN module. Alternatively or additionally, the communication interface is in the form of an interface to a wireless, local radio network.

Alternatively or additionally, the communication interface comprises a mobile radio interface which is designed to connect to a public mobile radio network. Such public mobile radio networks are used, in particular, to provide services for a mobile telephone. The mobile radio interface is designed, in particular, to use any desired service of the public mobile radio network, for example the voice service, the SMS service and/or a data transmission service.

According to embodiments of the invention, the communication interface is configured or designed, in terms of programming and/or circuitry, to establish and/or maintain access to the public Internet in order to wirelessly transmit information to one or more destination addresses. In particular, the alarm device is directly connected to the Internet and/or the Internet protocol (IP) of the TCP/IP model or the protocol of another Internet protocol family is used to transmit the information. In particular, the alarm device receives its own IP address and/or an IP address assigned to the alarm device upon connection to the public Internet. The destination addresses may be arbitrarily selected addresses, for example the address of an operations center, of a security service, of a company computer belonging to the proprietor of the alarm device, of a computer belonging to the proprietor's neighbor etc. In particular, the destination addresses are in the form of IP addresses.

The information preferably comprises indications of the environment- and/or device-specific state, in particular the event. The environment- and/or device-specific state is particularly preferably transmittable and/or transmitted as data content via the Internet.

Many companies or households already use WLAN (wireless local area network) technology to connect a plurality of devices in a building to the Internet. This is often effected using a so-called "flat rate", which means that Internet access and/or the Internet connection may be permanently available at affordable costs. The invention uses the high availability of such WLAN installations and proposes providing the alarm device with its own WLAN interface which makes it possible for the alarm device to have its own connection to the Internet. It goes without saying that a separate WLAN network may also be set up for the alarm device if necessary. Alternatively or additionally, the widely available mobile radio network is used with similar advantages, with the result that an alarm device with Internet capability is proposed within the scope of the invention.

A usable advantage of the invention is that destination addresses can be informed of the environment- and/or device-specific state of the alarm device, in particular of events, in real time via the Internet. These destination addresses have the opportunity to check the environment- and device-specific state even though they are not in an area surrounding the alarm device. An acoustic or optical alarm does not come to nothing if persons to be protected or monitored are not present since a communication of the event, in particular the hazardous situation, can be forwarded to the destination addresses via the Internet.

Another usable advantage of the invention is that the alarm device can be clearly located via the WLAN interface and/or via a WLAN router of the LAN network and/or via the IP address and/or via the telephone number. The destination address, for example the operations center, can thus immediately discern, upon the transmission of information, which alarm device is involved and where the latter is used. This is possible, for example, by decrypting the IP address or telephone number of the alarm device or by concomitantly transmitting location information.

It is likewise optionally possible to check the device-specific state of the alarm device from the outside. A person can therefore be certain, even when not present in the area surrounding the alarm device, that the alarm device is functional or can initiate appropriate actions in the event of an error message. Such a check can be carried out, for example, from a destination address or—with appropriate configuration—from any Internet access point in the world. It is also possible for the alarm device to be connectable and/or connected to an external data logger via the Internet, the states, in particular the device-specific states, being logged, with the result that evidence of the functionality of the alarm device can be created without having to check the alarm device in situ.

It is also advantageous that WLAN modules are sufficiently well known and are already widespread in many electronic devices, for example in portable computers or mobile telephones. WLAN modules of small physical sizes and with current-optimized properties which, by virtue of their size, can also be readily integrated in an alarm device are therefore also available. Another advantage which can be mentioned is that the WLAN modules have been available at reasonable costs in the meantime as a result of the demand for high quantities and the invention can thus be implemented at modest prices. Modules for mobile radio interfaces have also been available inexpensively in the meantime.

In one preferred embodiment, the alarm device is in the form of a smoke alarm and/or a fire alarm in a housing. In particular, the housing is designed to be mounted on the wall or ceiling of a room. Optionally, the alarm device may be battery-powered or may have a supply connection, in particular a mains connection.

In some embodiments, the alarm device has an on/off button. This makes it possible for a user, inter alia, to prevent or deactivate or deliberately activate information interchange with the destination addresses.

The alarm device preferably comprises a control unit for controlling a signal unit which is designed to output optical and/or acoustic alarm or all-clear signals, with the result that a local signal is produced at the location of the alarm device.

Alternatively or additionally, the control unit is also designed to control an electronic switch which can connect the communication interface to an energy source, for example a battery, or can disconnect the communication interface from the latter. The electronic switch can alternatively also be designed to change the alarm device to a power-saving mode and/or to disconnect the alarm device from the WLAN function or mobile radio function during transmission-free times.

If the environment-specific and/or the device-specific state is intended to be transmitted, a connection for transmitting the information via the communication interface can be activated by controlling the electronic switch. After transmission has been carried out, the alarm device is changed to a quiescent state, which has no power consumption or has a reduced power consumption, by controlling the electronic switch again.

It is advantageous that the control unit activates the communication connection via the electronic switch only at a transmission time and deactivates the connection in the quiescent state. No unnecessary energy is thus consumed by the WLAN module. In particular, if the alarm device has a supply connection, in particular a mains connection, the alarm device can also be optionally designed without the electronic switch. The alarm device can then be permanently supplied with energy and the communication connection can be permanently available.

In another possible refinement of the invention, the information is transmitted as an email, an SMS and/or a voicemail. The transmission of the email, the SMS and/or the voicemail is preferably Internet-based. In particular, the email and/or the SMS is/are transmitted to a computer and/or to a mobile device, for example a mobile telephone or a smartphone. When transmitting the voicemail, a voice message is usually transmitted on a permanently installed and/or location-based telephone connection.

In one possible embodiment, the alarm device has a configuration interface for transmitting transmission modalities. The configuration interface is preferably in the form of a data interface, in particular a USB interface. It is particularly preferred for the configuration interface to be arranged at an easily accessible location of the alarm device and to thus be connectable to a PC without any problems. Settings for connection set-up and for encryption, for instance WPA (Wi-Fi Protected Access), can be input via the PC and can be set using the configuration interface in the alarm device. The configuration interface likewise makes it possible, for example, to stipulate the web addresses, email addresses, telephone numbers or passwords for the desired destination addresses via the PC.

In another possible embodiment, the alarm device is designed to actively transmit the information to the at least one destination address. The alarm device preferably has a push function during which it actively transmits the information. For example, it independently controls the transmission of an alarm message to the at least one destination address in a hazardous situation.

It is also conceivable for the alarm device to transmit an all-clear message, in particular within the scope of the push function, in the case of normal situations without being requested to do so, optionally at configured points in time, for example every eight hours or once a day. It is also conceivable for a reset message, which was effected by persons in an area surrounding the alarm device, to be able to be transmitted from the alarm device to the destination addresses. As a result, the destination addresses realize that a false alarm was stopped by the persons or the hazardous situation is eased.

Optionally, the functional parameters may also be automatically transmitted by the alarm device as device-specific states. This may be carried out cyclically, for example. This makes it possible, for example, for a battery status, a degree of soiling of the sensor unit and/or a status message of the electronics etc. of the alarm device to be checked from the destination address and for corresponding repairs to be initiated.

In another possible embodiment, the alarm device has a memory unit for storing the information, the information being retrievable and/or retrieved from at least one destination address. In particular, the alarm device supports a pull function during which the alarm device itself remains passive and the information is actively accessed from the outside. For example, the at least one destination address or further destination addresses may interrogate the device-specific state, in particular the functional parameters of the alarm device, at any desired times and/or at fixed intervals of time and can thus be informed of a functional status. Alternatively or additionally, the environment-specific state, in particular the environmental parameters, can be retrieved.

It is conceivable for the information to comprise alarm signals or all-clear signals. The alarm signals preferably comprise specific indications of the hazardous situation. When the alarm device is in the form of a smoke alarm and/or a fire alarm, a hazardous situation is present, for example, when the sensor unit records an increased smoke particle concentration in the area surrounding the smoke alarm and the evaluation unit detects a fire. All-clear signals comprise, in particular, specific indications of the normal situation. In the normal situation, the sensor unit, for example when the alarm device is in the form of a smoke alarm and/or a fire alarm, records a gas and/or particle concentration for which the evaluation unit does not detect a fire.

The information optionally comprises one or more status protocols. The status protocols preferably comprise function signals and/or service signals of the alarm device. This may be, in particular, an indication of a weak battery status or a defective warning light of the alarm device, for example.

One possible refinement of the invention provides for the public Internet to be accessed via the mobile radio network. Possible mobile radio networks are GSM, GPRS or UMTS, for example. No further communication interfaces or additional devices, in particular the WLAN module, are preferably required in this development.

Another subject matter of the invention relates to an alarm system having a receiving station and at least one alarm, the receiving station being coupled to the Internet. The receiving station is preferably in the form of a WLAN router. In particular, the alarm system has a plurality of alarm devices which are connected to one another and to the receiving station via WLAN.

For example, the alarm devices and the receiving station may be arranged at different locations within an extensive building complex. An alarm signal from an alarm device, which is arranged in a section of the building, is then forwarded to the other alarm devices and to the receiving station. This makes it possible to inform persons of the hazardous situation even over long distances and/or at the other end of the building complex. The information is transmitted virtually at the same time to the destination addresses by the receiving station connected to the Internet.

It is likewise conceivable for a person in a room of the building complex to transmit a reset message from an alarm device and thus to be able to also reset all further alarm devices in the building complex via the WLAN connection. The reset message can be optionally transmitted to the destination addresses or further destination addresses via the coupling between the receiving station and the Internet.

It goes without saying that the alarm system and/or the alarm devices can also remain passive, that is to say support(s) the pull function, and the destination addresses or further destination addresses retrieve the information via the coupling to the Internet.

BRIEF DESCRIPTION OF THE DRAWINGS

Further features, advantages and effects of the invention emerge from the following description of preferred exemplary embodiments of the invention and the accompanying figures, in which.

DETAILED DESCRIPTION

Mutually corresponding or identical parts are each provided with the same reference symbols in the figures.

Figure 1:
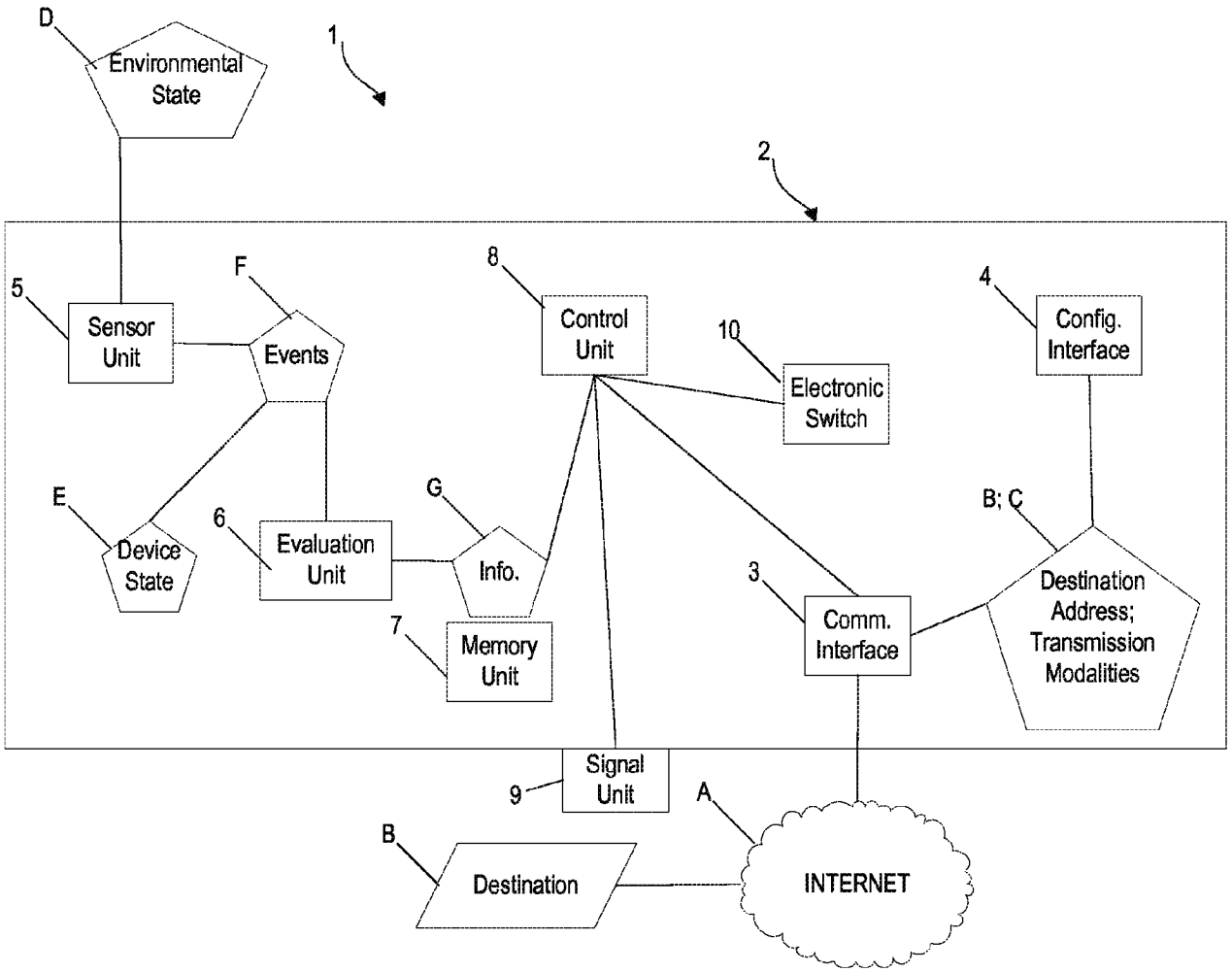
FIG. 1 shows a structural illustration of an alarm device as an exemplary embodiment of the invention.

A preferred exemplary embodiment of the invention is shown in FIG. 1 which illustrates a block diagram of an alarm device 1. The alarm device 1 is in the form of a battery-powered smoke alarm and is integrated in a housing 2 which is designed for ceiling or wall mounting. The housing 2 has an outer side and an inner side, the outer side being arranged so as to be visible to persons in the area surrounding the alarm device 1.

The alarm device 1 comprises a communication interface 3 and a configuration interface 4, the configuration interface 4 being arranged so as to be accessible from the outer side of the housing 2. The alarm device 1 also comprises a sensor unit 5, an evaluation unit 6, a memory unit 7, a control unit 8, a signal unit 9 and an electronic switch 10. The signal unit 9 comprises a warning light and an alarm sound generator and is arranged on the outer side of the housing 2.

The communication interface 3 is implemented as a WLAN interface which is designed to establish access and/or a connection between the alarm device 1 and the public Internet A. The connection may be effected, for example, via a WLAN router (not illustrated).

In an alternative exemplary embodiment of the invention, the communication interface 3 is in the form of a mobile radio interface which is used to establish the connection to the public Internet A. A dual interface which provides both a mobile radio network function and a WLAN function is also possible.

The control unit 8 controls the electronic switch 10 in order to activate a power supply for the alarm device 1 with a battery and to change the alarm device from a quiescent state to a transmission state.

The configuration interface 4 is in the form of a USB interface and is suitable for transmitting transmission modalities C. The configuration interface 4 makes it possible to connect a computer which can be used to set, inter alia, destination addresses B and connection and encryption data for the Internet connection as transmission modalities.

The sensor unit 5 is intended to record environmental parameters which indicate an environment-specific state D. The environmental parameters include, inter alia, an increased smoke particle concentration in ambient air, an increased temperature, optical emission of flames or a blaze which indicate a fire.

The alarm device 1 records functional parameters which indicate a device-specific state E. The functional parameters comprise, for example, a weak battery status of the alarm device 1, which indicates a service state.

The evaluation unit 6 is designed to evaluate the environment- and device-specific states D; E. It detects events F, for example a hazardous situation or a normal situation, and/or whether a maintenance or repair service is required for the alarm device 1.

The memory unit 7 stores information G relating to the events F detected by the evaluation unit 6. The information G comprises alarm signals, all-clear signals and/or status protocols. The status protocols have signals which indicate functionality of the alarm device 1. The status protocols thus contain, for example, function and/or service signals of the alarm device 1.

If the evaluation unit 6 evaluates an environment-specific state which indicates a fire, the memory unit 7 stores an alarm signal. If the environment-specific state indicates a normal situation, the memory unit stores an all-clear signal. When evaluating the device-specific states which indicate, for example, a weak battery level or impairment of the sensor unit 5 as a result of soiling, the memory unit 7 stores a status protocol with service signals. In contrast, the status protocol contains function signals when the function of the alarm device 1 is not impaired and the alarm device operates without any problems.

The control unit 8 is designed to control the signal unit 9. If the evaluation unit 6 detects a hazardous situation, for example increased smoke development in the ambient air, the control unit 8 controls the signal unit 9 such that the warning light illuminates and the alarm sounds.

The control unit 8 controls the communication interface 3 virtually at the same time as the signal unit 9 in order to activate the connection to the Internet A and to transmit the information G to the destination addresses B.

Figure 2:
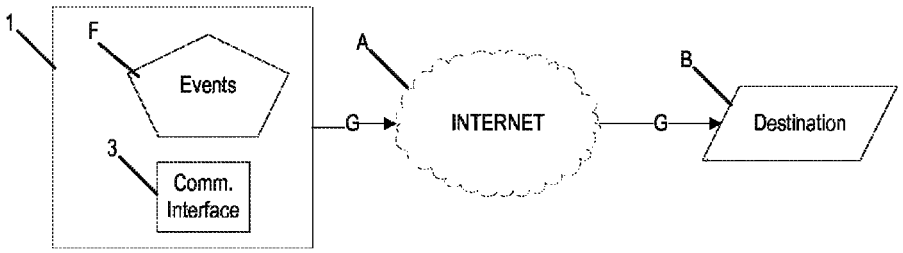
FIG. 2 shows a transmission path of the information from the alarm device from FIG. 1.

FIG. 2 shows a transmission path of the information G from the alarm device 1 from FIG. 1. The alarm device 1 is connected to the public Internet A via the communication interface 3 and actively transmits the information G to the configured destination addresses B in the event F. In this case, the alarm device 1 implements a push function since it independently transmits the information G to the destination addresses B.

Figure 3:
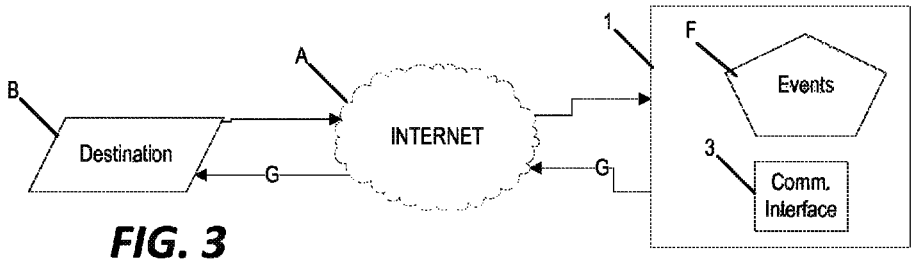
FIG. 3 shows an alternative transmission path to the illustration from FIG. 2.

FIG. 3 shows an alternative transmission path of the information G from the alarm device 1 from FIG. 1. The alarm device 1 is connected to the Internet A via the communication interface 3. The destination addresses B retrieve the stored information G from the alarm device 1 in turn, for example, the alarm device 1 itself remaining passive and supporting a pull function. The destination addresses B have access to the information G as a result of the pull function.

Figure 4:
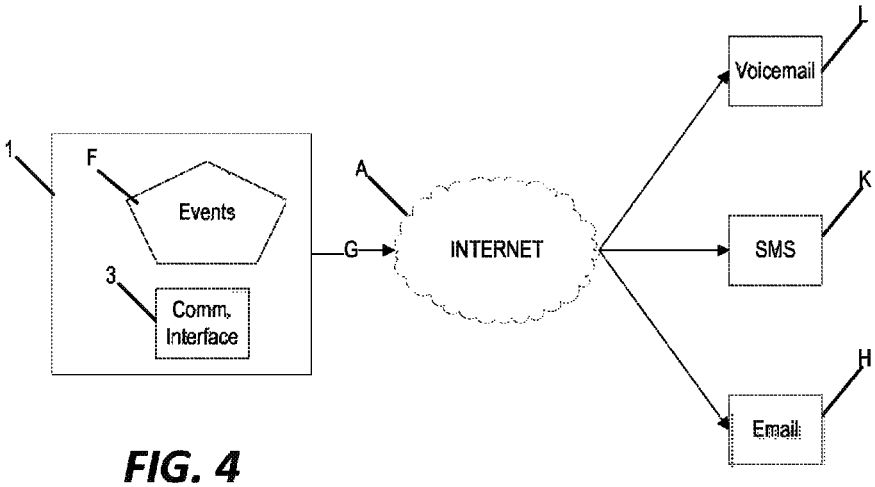
FIG. 4 shows possibilities for transmitting the information from the alarm device from FIG. 1.

FIG. 4 shows further possibilities for transmitting the information G from the alarm device 1 from FIG. 1. The communication interface 3 is designed to transmit the information G to a server for the destination addresses B via the Internet A. According to the configuration settings, the information G is output as an email H, an SMS K and/or a voicemail L. The email H and the SMS K are output on a screen of a computer or a mobile device, for example a mobile telephone. The voicemail L is usually effected on a telephone connection, in particular a landline connection.

Figure 5:
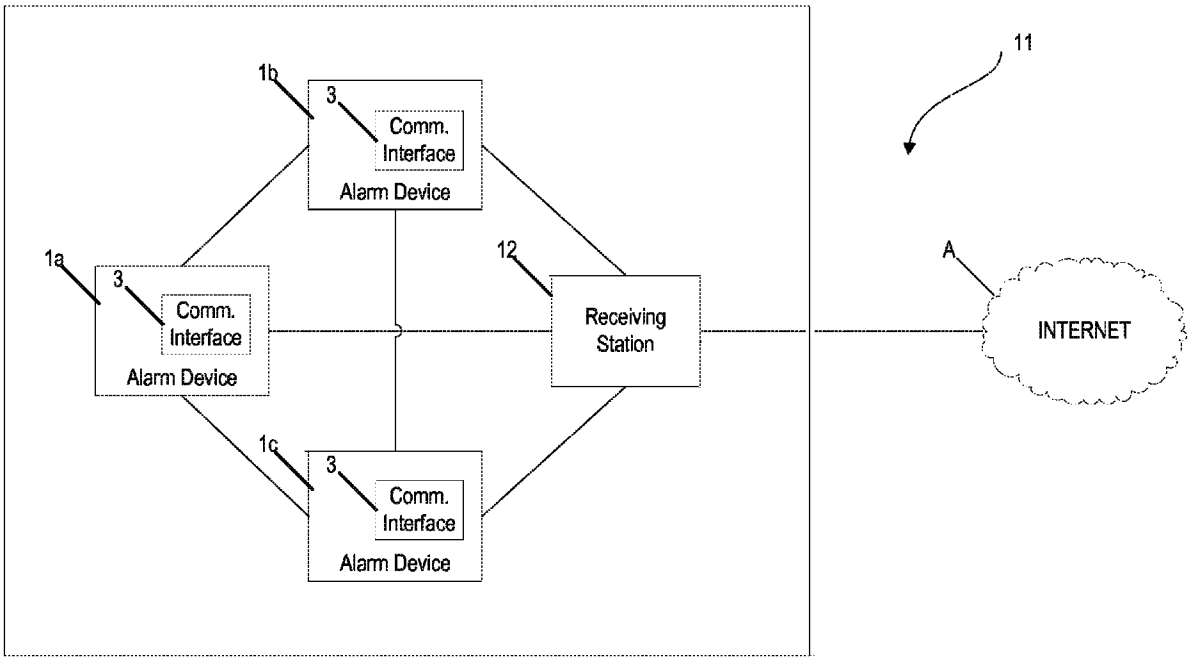
FIG. 5 shows an alarm system having three alarm devices according to FIG. 1 and a receiving station.

FIG. 5 shows an alarm system 11 comprising three alarm devices 1*a*; 1*b*; 1*c* and a receiving station 12. The alarm devices 1 are connected to one another and to the receiving station 12 via WLAN. The receiving station 12 is in the form of a WLAN router and couples the alarm devices 1 to the public Internet A, as a result of which the push and/or pull function of the alarm device 1 is provided.

What is claimed is:

1. An alarm device comprising:

a housing;

a sensor unit at least partially supported by the housing and configured to detect environmental parameters that indicate an environment-specific state;

an evaluation unit that evaluates the environment-specific state and device-specific states of the alarm device to detect events;

a wireless communication interface at least partially supported by the housing and configured to establish access to the Internet, and transmit information related to the detected environmental state and the device-specific states to one or more destination addresses via the Internet; and a control unit for providing a warning and for controlling the wireless communication interface to transmit information related to the detected environmental state and the device-specific states.

2. The alarm device as claimed in claim 1, further comprising an electronic switch for connecting the communication interface to an energy source, wherein the control unit controls the electronic switch to connect or disconnect the wireless communication interface from an energy source.

3. The alarm device of claim 1, further including an electronic switch for changing the alarm device to a power-saving mode.

4. The alarm device of claim 3, wherein the control unit activates the communication connection via the electronic switch only at a transmission time and deactivates the connection in a quiescent state having no power consumption or reduced power consumption.

5. The alarm device of claim 1, wherein the device-specific states include battery status, a degree of soiling of the sensor unit and/or a status message of the electronics.

6. The alarm device of claim 1, wherein the environmental parameters include at least one from a group consisting of an increased smoke particle concentration in ambient air, an increased temperature, optical emission of flames or a blaze which indicates a fire.

7. The alarm device of claim 1, further including a memory unit that stores information relating to the events.

8. The alarm device of claim 7, wherein the information stored in the memory unit is actively accessed from the at least one destination address or further destination addresses may interrogate the device-specific state, while the alarm device itself remains passive.

9. The alarm device of claim 1, further comprising:

a configuration interface for transmitting transmission modalities, and a signal unit arranged on an outer side of the housing, the signal unit controlled by the control unit to provide the warning.

10. The alarm device of claim 1, wherein the alarm device receives an IP address and/or an IP address is assigned to the alarm device upon connection to the Internet.

11. The alarm device of claim 1, wherein the destination addresses are IP addresses.

12. An alarm device comprising:

a housing;

a sensor unit at least partially supported by the housing and configured to detect environmental parameters that indicate environment-specific states; and an evaluation unit that evaluates the environment-specific states and device-specific states of the alarm device to detect events;

a signal unit arranged on an outer side of the housing;

a wireless communication interface at least partially supported by the housing and configured to establish access to the Internet, and transmit information related to the detected environmental states and the device-specific states to one or more destination addresses via the Internet; and a control unit for controlling the signal unit to provide a warning and for controlling the wireless communication interface to transmit information related to the detected environmental states and the device-specific states.

13. The alarm device as claimed in claim 12, further comprising an electronic switch for connecting the communication interface to an energy source, wherein the control unit controls the electronic switch to connect or disconnect the wireless communication interface from an energy source.

14. The alarm device as claimed in claim 12, further including a memory unit that stores information relating to the events, wherein the information stored in the memory unit is actively accessed from the at least one destination address or further destination addresses may interrogate the device-specific state, while the alarm device itself remains passive.

* * * * *